US006699105B1

(12) United States Patent
Ohmori et al.

(10) Patent No.: US 6,699,105 B1
(45) Date of Patent: Mar. 2, 2004

(54) METHOD AND APPARATUS FOR CUTTING AND GRINDING SINGLE CRYSTAL SIC

(75) Inventors: Hitoshi Ohmori, Wako (JP); Yutaka Yamagata, Wako (JP); Nobuhide Itoh, Hitachi (JP); Nobuyuki Nagato, Chiba (JP); Kotaro Yano, Chiba (JP); Naoki Oyanagi, Chiba (JP)

(73) Assignees: Riken, Saitama (JP); Showa Denko K.K., Tokyo (JP)

( * ) Notice: Subject to any disclaimer, the term of this patent is extended or adjusted under 35 U.S.C. 154(b) by 0 days.

(21) Appl. No.: 09/530,658

(22) PCT Filed: Sep. 1, 1999

(86) PCT No.: PCT/JP99/04729

§ 371 (c)(1),
(2), (4) Date: Jul. 5, 2000

(87) PCT Pub. No.: WO00/13870

PCT Pub. Date: Mar. 16, 2000

(30) Foreign Application Priority Data

Sep. 4, 1998 (JP) ..... 10/250611

(51) Int. Cl.[7] ..... B24B 1/00
(52) U.S. Cl. ..... 451/56; 125/11.01; 125/11.22
(58) Field of Search ..... 451/56, 72, 443, 451/908, 36; 125/13.01, 11.01, 11.22

(56) References Cited

U.S. PATENT DOCUMENTS 4,930,486 A * 6/1990 Kuromatsu
5,551,908 A * 9/1996 Harada
6,110,019 A * 8/2000 Ohmori
6,117,001 A * 9/2000 Enomoto et al.
6,149,504 A * 11/2000 Ohmori et al.
6,244,939 B1 * 6/2001 Ohmori et al.

FOREIGN PATENT DOCUMENTS

| | | |
|---|---|---|
| JP | 58-59566 | 4/1983 |
| JP | 62-264869 | 11/1987 |
| JP | 1-175166 | 12/1989 |
| JP | 5-104438 | 4/1993 |
| JP | 9-187815 | 7/1997 |

* cited by examiner

*Primary Examiner*—Dung Van Nguyen
(74) *Attorney, Agent, or Firm*—Griffin & Szipl, PC

(57) ABSTRACT

The present invention comprises a metal bond grind stone having a flat plate portion 10*a* and a tapered portion 10*b*; an electrode 13 opposed to the metal bond grind stone with a gap therebetween; voltage applying means 12 for applying a direct-current pulse voltage between the metal bond grind stone and the electrode; conductive liquid supplying means 14 for supplying a conductive liquid 15 between the metal bond grind stone and the electrode; and grind stone moving means 16 for moving the metal bond grind stone in a direction orthogonal to the shaft center thereof, and an ingot 1 of a single crystal SiC is thereby cut at the tapered portion 10*b* of the metal bond grind stone and the cut surface is then specular-worked at the flat plate portion 10*a*.

8 Claims, 4 Drawing Sheets

METHOD AND APPARATUS FOR CUTTING AND GRINDING SINGLE CRYSTAL SIC

BACKGROUND OF THE INVENTION

1. Field of the Invention

The present invention relates to a method and an apparatus for cutting and grinding a single crystal SiC for use in a hard electronics.

2. Description of the Prior Art

The hard electronics generically designates a strong electronics which uses a wide gap semiconductor such as SiC or diamond having a value of physical property above that of silicon as a base and can meet a hard specification over this limit. A band gap of SiC or diamond which is dealt in the hard electronics ranges from 2.5 to 6 eV, as compared with 1.1 eV of Silicon.

The history of the semiconductor started from germanium and shifted to silicon having a larger band gap. The largeness in the band gap is associated with that in chemical binding power between atoms constituting a matter, and not only is a material very hard, but a value of physical property required for the hard electronics such as a dielectric breakdown electric field, a carrier saturation drift velocity, a thermal conductivity and others is far superior to that of silicon. For example, there is a Johnson index to a high-speed and large-output device as one performance index of the hard electronics and, assuming that the index of silicon is 1, the index of the semiconductor of the hard electronics decuples or centuples that value as shown in FIG. 1.

Therefore, the hard electronics is expected as a substitution for the conventional silicon semiconductor in the fields of the energy electronics represented by a power device, the information electronics in which milli-meter wave/microwave communication is mainly dealt, the extreme environment electronics such as nuclear energy, geothermal sources, space and the like.

In the hard electronics, the study of an SiC power device is most advanced. However, even in SiC with which studies for realizing devices are most advanced, the conventional silicon processing technique can not be directly applied for realizing the elemental device because SiC has strong chemical binding power and is a hard material.

That is, in order to manufacture a device from an ingot of a single crystal SiC, the ingot must be cut out in a tabular form and its surface must be flatly finished as in the prior art. However, when applying conventional silicon cutting means to cutoff of the single crystal SiC, the finishing speed is slow and a step called a saw mark tends to be produced on the cut surface because the single crystal SiC is a hard and chemically stable material. When such a step is once produced, a very long time is required for mechanically grinding to obtain a flat surface because the single crystal SiC is a hard and chemically stable material, thereby largely reducing the productivity of the hard electronics material.

Further, in the conventional silicon, the roughness of a cut surface obtained by the cutting means is planed by polishing by another device using chemical etching after cutoff. However, the chemical etching applied to a conventional silicon material is hard to be applied to the single crystal SiC which is a chemically stable material for this planation.

SUMMARY OF THE INVENTION

The present invention is intended to solve the above-described problems. That is, it is an object of the present invention to provide a method and an apparatus for cutting and grinding a single crystal SiC, by which an ingot of the single crystal SiC can be efficiently cut out in a tabular form and its cut surface can be finished to be as flat as a mirror surface.

As grinding means for realizing highly-efficient/superfine specular grinding which is impossible in the conventional polishing technique, an electrolytic in-process dressing grinding method (which will be referred to as an ELID grinding method hereinafter has been developed by the present applicant. According to this ELID grinding method, a conductive bonding portion of a metal bond grind stone is dissolved by the electrolytic dressing and ground while performing truing. By this grinding method, use of the metal bond grind stone having fine abrasives enables excellent grinding which is efficient to the hard material, and the high streamline/ultrasophistication can be intended. The present invention can take advantages of the ELID grinding method and utilizes this method to the grinding and the cutoff of the single crystal SiC.

That is, according to the present invention, there can be provided a method for cutting and grinding a single crystal SiC, wherein a metal bond grind stone (10) is applied to positive potential while an electrode opposed to this metal bond grind stone is applied to negative potential; a conductive liquid (15) is supplied between the metal bond grind stone and the electrode; the surface of the metal bond grind stone is subjected to the electrolytic dressing by applying a direct-current pulse voltage between the metal bond grind stone and the electrode while an ingot (1) of a single crystal SiC is cut out by using the metal bond grind stone (10); and the cut surface is then subjected to grinding by using the metal bond grind stone.

According to the method of the present invention, although the cutting and the grinding can be performed using separate grind stones or apparatuses, when the surface of the metal bond grind stone (10) is subjected to the electrolytic dressing while cutting the ingot (1) of the single crystal SiC by using the metal bond grind stone and the metal bond grind stone is then used for the grinding of the cut surface, even the ingot of the hard single crystal SiC can be efficiently cut out by using the abrasives trued by the electrolytic dressing. Further, since the surface of the metal bond grind stone can be precisely trued by the electrolytic dressing, the cut surface can be finished to be as flat as a mirror surface by using the fine abrasives.

According to a preferred mode for embodying the present invention, the metal bond grind stone consist of a cast iron based metal binding material and diamond abrasives having particle sizes different at a flat plate portion (10*a*) and a tapered portion (10*b*), and the ingot (1) of the single crystal SiC can be cut off by the tapered portion (10*b*) so that the cut surface can be subjected to the grinding by the flat plate portion (10*a*).

By this method, since the both surfaces of the tapered portion (10*b*) can obliquely cut into the ingot (1) of the single crystal SiC by only moving the metal bond grind stone (10) in a direction orthogonal to an shaft center, the efficient cutoff is possible. Furthermore, since the flat plate portion (10*a*) is provided to the inner side, the cut surface can be finished on a flat surface orthogonal to the shaft center of the grind stone.

Moreover, it is preferable that the flat plate portion (10*a*) and the tapered portion (10*b*) of the metal bond grind stone (10) are composed of diamond abrasives having different particle size's and an iron cast based metal binding material.

With this structure, when the particle size in the flat plate portion (10*a*) is minimized and that in the tapered portion (10*b*) is roughened for example, the efficiency at the time of cutoff is improved and the finishing precision of the cut surface can be enhanced.

In addition, according to the present invention, there is provided an apparatus for cutting and grinding a single crystal SiC comprising: a metal bond grind stone (10) constituted by a flat plate portion (10*a*) rotating around a shaft center and a tapered portion (10*b*) which is provided to the outside of the flat plate portion and formed in such a manner that its outer side is gradually thinned; an electrode (13) opposed to the metal bond grind stone with a gap therebetween; voltage applying means (12) for applying a direct-current pulse voltage between the metal bond grind stone as an anode and the electrode as an cathod; conductive liquid supplying means (14) for supplying a conductive liquid (15) between the metal bond grind stone and the electrode; and grind stone moving means (16) for moving the metal bond grind stone in a direction orthogonal to the shaft center, thereby cutting the ingot (1) of the single crystal SiC by using the tapered portion (10*b*) of the metal bond grind stone to then subject the cut surface to the grinding using the flat plate portion (10*a*).

With this structure according to the present invention, when the electrolytic dressing is applied to the taper portion (10*b*) of the metal bond grind stone, even the ingot of the hard single crystal SiC can be efficiently cut off by using the abrasives smoothed by the electrolytic dressing. Additionally, since the surface can be precisely trued by performing the electrolytic dressing on the flat plate portion (10*a*) of the metal bond grind stone, the cut surface can be finished into a flat surface orthogonal to the shaft center of the grind stone and this surface can be finished to be as flat as the mirror surface by using the fine abrasives.

DESCRIPTION OF PREFERRED EMBODIMENTS

Figure 1:
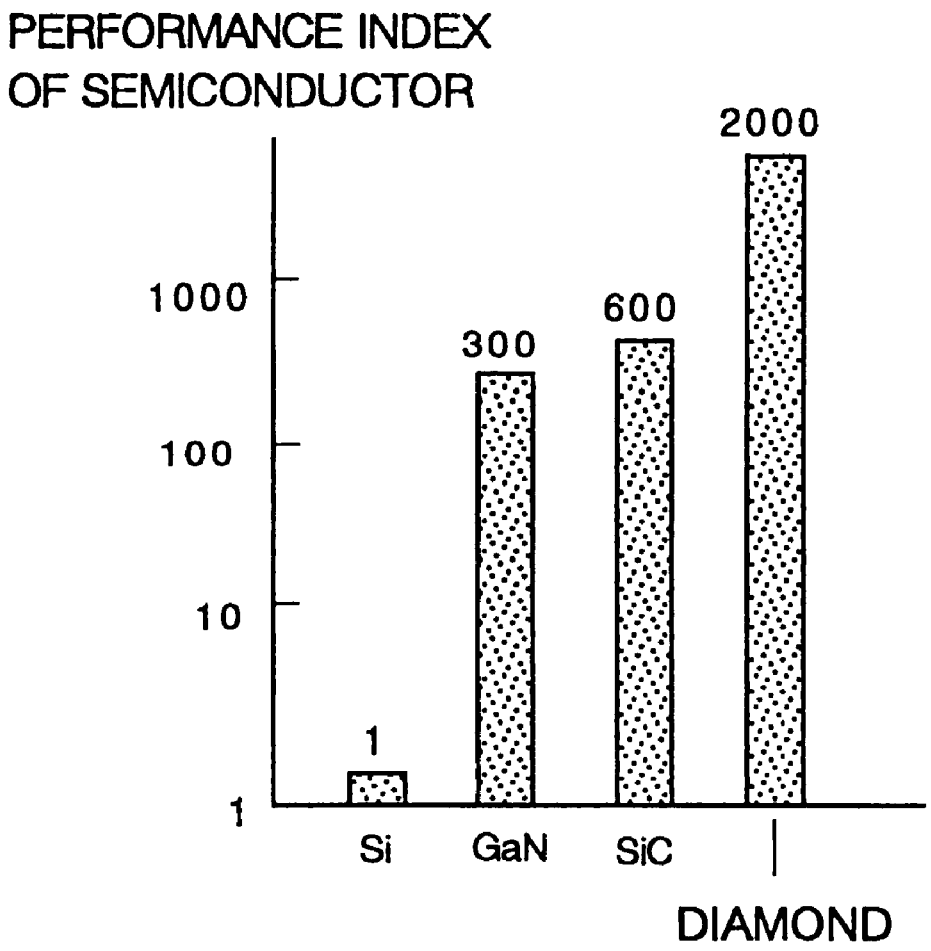
FIG. 1 is a drawing for comparing a performance of conventional Si with that of a hard electronics substrate.

A preferred embodiment according to the present invention will now be described with reference to the drawings. It is to be noted that like reference numerals denote like or corresponding part, thereby omitting tautological explanation. In the following example, description will be given as to the case where cutoff and grinding are carried out by using the same metal bond grind stone.

Figure 2:
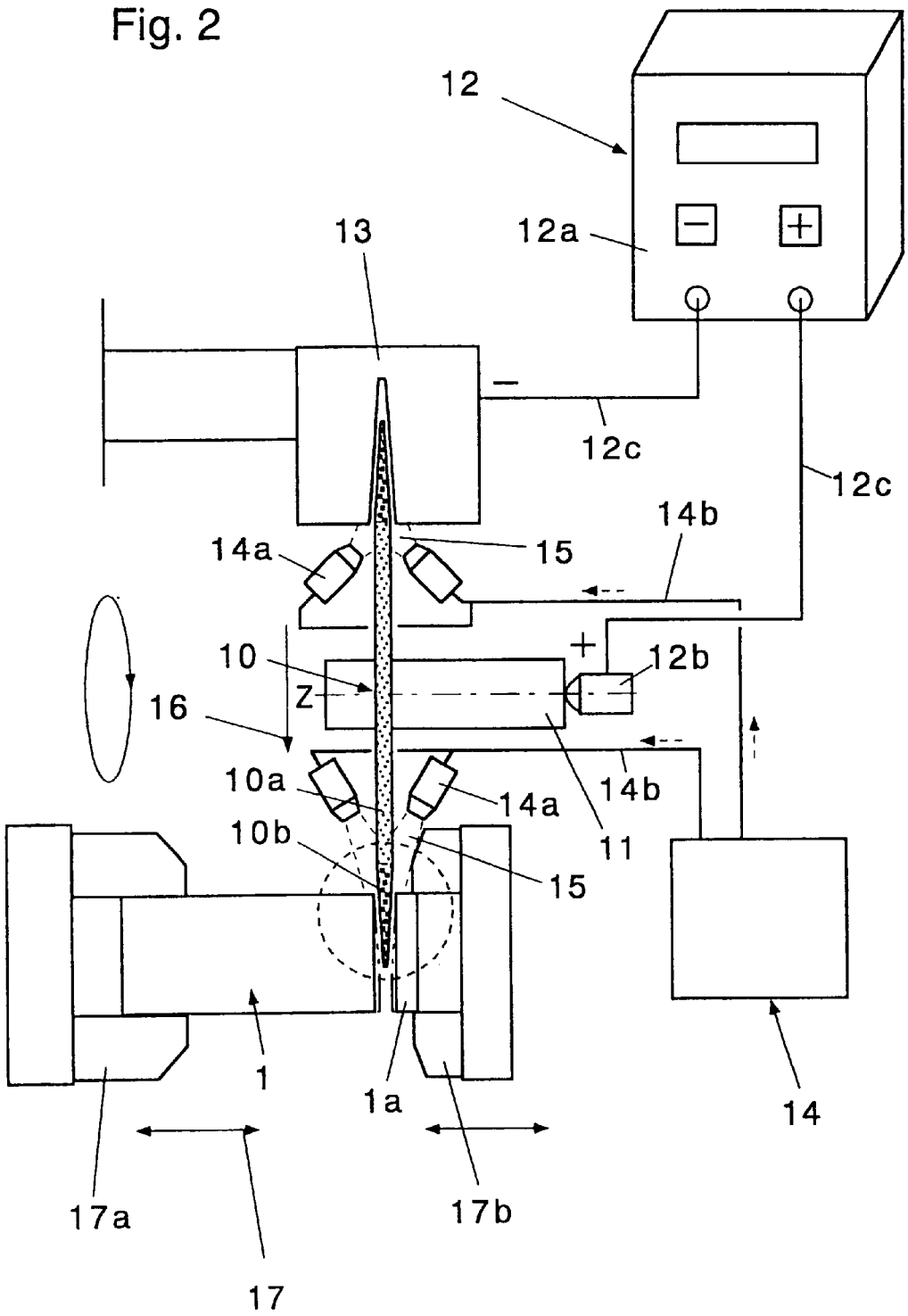
FIG. 2 is a typical block diagram of an apparatus for cutting and grinding a single crystal SiC according to the present invention.
Figure 3:
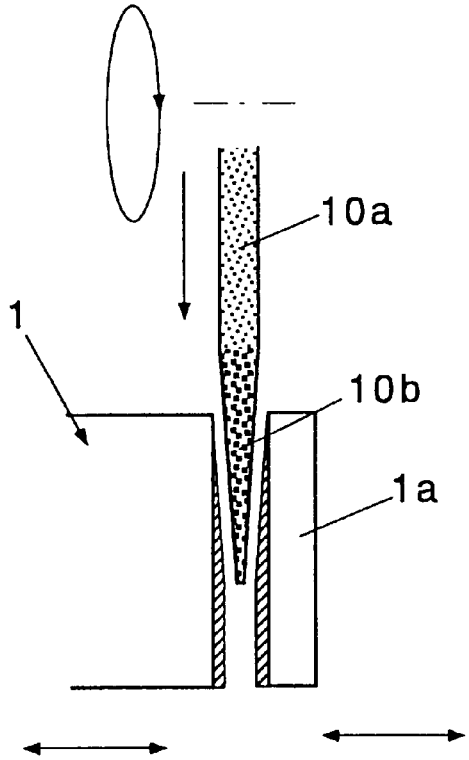
FIG. 3 is an enlarged view of a section A in FIG. 2.

FIG. 2 is an example of a typical block diagram of an apparatus for cutting and grinding a single crystal SiC according to the present invention, and FIG. 3 is an enlarged view of a section A in FIG. 2. As shown in the drawings, the apparatus for cutting and grinding a single crystal SiC according to the present invention comprises: a metal bond grind stone 10; voltage applying means 12; an electrode 13; conductive liquid supplying means 14; and grind stone moving means 16.

The metal bond grind stone 10 is constituted by a flat plate portion 10*a* which rotates around a shaft center at high speed by a non-illustrated driving device and a tapered portion 10*b* which is provided to the outside of the flat plate portion 10*a*. In this example, the tapered portion 10*b* is formed in such a manner that the outer periphery in the radial direction is gradually thinned.

Figure 5:
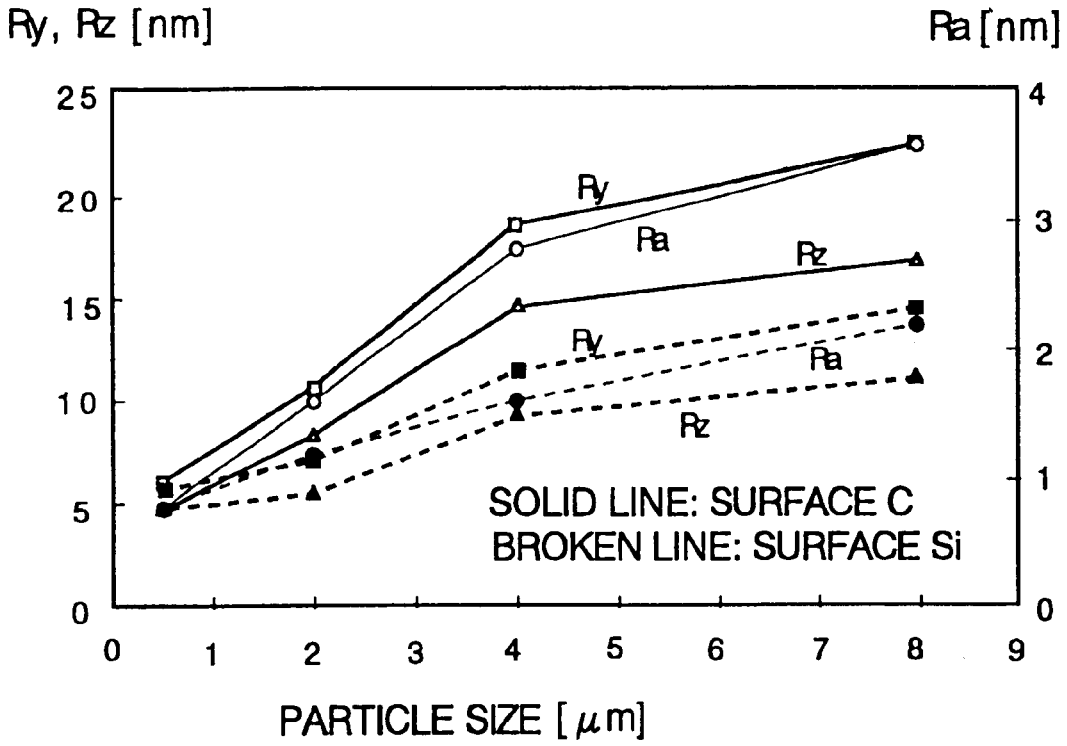
FIG. 5 is a drawing showing the relationship between a particle size and a surface roughness of an abrasive in the single crystal SiC.

Further, in this example, the flat plate portion 10*a* and the tapered portion 10*b* of the metal bond grind stone 10 are composed of diamond abrasives having different particle sizes and an iron cast based metal binding material. The particle size of the flat plate portion 10*a* becomes preferable when the particle diameter is finer, in order to process the final surface to be as flat as the mirror surface, and the particle diameter of, e.g., 2 $\mu$m (corresponding to the particle size of #8000) to 5 nm (corresponding to the particle size of #3,000,000) is used. Further, as to the particle size of the tapered portion 10*b*, it is preferable that the particle diameter is relatively rough for enhancing the cutting efficiency, and the tapered portion having the particle size of #325 to the particle diameter of 4 $\mu$m (corresponding to the particle size of #4000) is preferably used for example. As shown in FIG. 5 which will be described later, the efficient cutoff is possible at the tapered portion 10*b* by using such abrasives, and the surface can be finished to be as flat as the mirror surface at the flat plate portion 10*a*.

The electrode 13 is opposed to the flat plate portion 10*a* and the tapered portion 10*b* of the metal bond grind stone 10 with a small gap therebetween. This gap is uniform and preferably capable of being adjusted. Incidentally, although the electrode 13 is opposed only to the tapered portion 10*b* in the drawing, the electrode 13 is opposed to the flat plate portion 10*a* at a non-illustrated different position. Further, different electrodes may be separately provided so as to be opposed to the flat plate portion 10*a* and the tapered portion 10*b*.

The voltage applying means 12 comprises a power supply 12*a*, a supply device 12*b*, and a power supply line 12*c* electrically connecting the electrode 13, the supply device 12*b* and the power supply 12*a*, and it is designed to apply a voltage between the metal bond grind stone 10 and the electrode 13 through the supply device 12*b*. As the power supply 12*a*, a constant current ELID power supply which can supply a direct-current voltage in the form of pulses is preferable. In this example, the supply device 12*b* directly comes into contact with the grind stone shaft portion 11 and applies a positive power to the grind stone 10 and a negative power to the electrode 13 so that the direct-current pulse voltage is applied between the metal bond grind stone 10 (anode) and the electrode 13. As described above, when different electrodes are separately provided and opposed to the flat plate portion 10*a* and the tapered portion 10*b*, different direct-current pulse voltages may be applied.

The conductive liquid supplying means 14 includes: nozzles 14*a* positioned to face to the gap between the metal bond grind stone 10 and the electrode 13 and the contact portion between the metal bond grind stone 10 and the ingot 1 (work) of the single crystal SiC; and conductive liquid lines 14*b* for supplying a conductive liquid 15 to these nozzles 14*a*, and this means 14 is designed to supply the conductive grinding liquid to the gap between the grind stone 10 and the electrode 13 and the contact portion between the grind stone 10 and the work 1.

The grind stone moving means 16 moves the metal bond grind stone 10 in a direction orthogonal to the shaft center Z by a non-illustrated driving device. Further, in this drawing, reference numeral 17 denotes work moving means which includes a main damper 17*a* for holding the ingot 1 (work) of the single crystal SiC and an auxiliary clamper 17*b* for holding a cutout work piece 1*a*. The main clamper 17*a* and the auxiliary clamper 17*b* hold the work 1 and the work piece la so that they can independently move in a direction (indicated by double arrows in the drawing) of the shaft center Z of the grind stone 10.

With the above-described arrangement according to the present invention, since the both surfaces of the tapered portion 10*b* having the abrasives trued by the electrolytic dressing obliquely cut into the ingot 1 of the single crystal SiC by only moving the metal bond grind stone 10 in a direction orthogonal to the shaft center Z as shown in FIG. 3, the efficient cutting can be effected even if the ingot 1 of the hard single crystal SiC is used. Further, when the flat plate portion 10*a* of the metal bond grind stone is subjected to the electrolytic dressing, the surface can be precisely trued, and hence the cut surface can be finished to be a flat surface orthogonal to the shaft center of the grind stone by directly feeding the grind stone 10 after cutting the work 1. Moreover, using the fine abrasives in the flat plate portion 10*a* can excellently finish this surface as flat as the mirror surface.

Additionally, according to the method of the present invention, it is determined that the metal bond grind stone 10 is an anode while the electrode 13 opposed to the metal bond grind stone 10 is a cathode; the conductive liquid 15 is supplied between the metal bond grind stone 10 and the electrode 13; the direct-current pulse voltage is applied between the metal bond grind stone 10 and the electrode 13 to thereby subject the surface of the metal bond grind stone to the electrolytic dressing; the ingot 1 of the single crystal SiC is cut out by the. metal bond grind stone 10; and the cut surface is then specular-worked by the metal bond grind stone 10.

According to this method, although the cutting and the grinding can be carried out by using different grind stones or apparatuses respectively, even the ingot of the hard single crystal SiC can be efficiently cut out by the abrasives trued by the electrolytic dressing, when performing the electrolytic dressing on the surface of the metal bond grind stone 10 while cutting out the ingot 1 of the single crystal SiC by using this metal bond grind stone 10 and then grinding the cut surface by the same metal bond grind stone 10. Since the surface of the metal bond grind stone can be precisely trued by the electrolytic dressing, the cut surface can be excellently finished as flat as the mirror surface.

Figure 4:
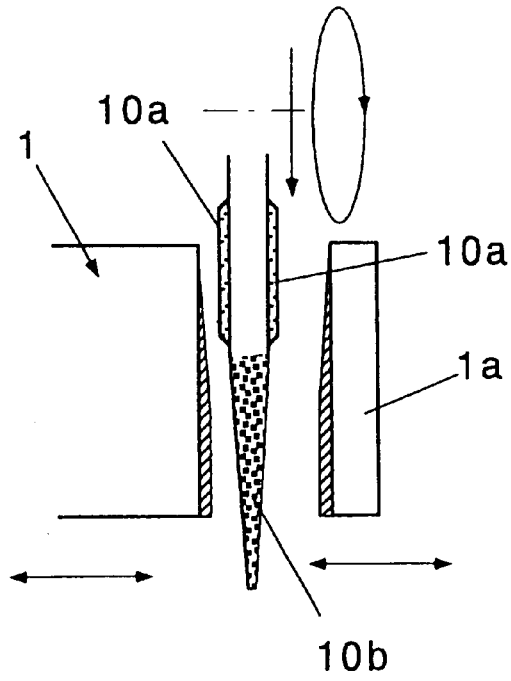
FIG. 4 is an another block diagram of a metal bond grind stone according to the present invention.

FIG. 4 is another block diagram of the metal bond grind stone according to the present invention. As shown in this drawing, the flat plate portion 10*a* can be formed so as to protrude from the side surface of the metal bond grind stone 10. In this case, a gap of the cut surface is enlarged by the main clamper 17*a* and the auxiliary clamper 17*b* after cutting the work 1 by the tapered portion 10*b*, and the cut surface is specular-worked by the flat plate portion 10*a*. With this structure, the finishing precision of the flat plate portion 10*a* by the ELID grinding can be enhanced, and the cut surface can be excellently finished as flat as the mirror surface.

Incidentally, although the surface of the metal bond grind stone 10 at the tapered portion 10*b* is a linear surface which is obliquely intersectional with respect to the shaft center Z of the metal bond grind stone 10 in the example shown in FIGS. 2 to 4, this surface can be formed so as to be gradually thinned toward the outer periphery thereof, if necessary.

FIG. 5 is a drawing showing the relationship between the surface roughness and the particle size of the abrasive in the single crystal SiC. This drawing shows the surface roughness obtained when the carbon side and the silicone side of the single crystal SiC are ground by the ELID grinding. It is to be noted that solid lines indicate a surface C (carbon side) of the single crystal SiC and broken lines indicate a surface Si (silicon side) of the same in this drawing.

As apparent from this drawing, when using the diamond abrasives having a particle size of 0.5 $\mu$m to 8 $\mu$m, the finished surface C tends to be rougher than the surface Si as a whole. However, the finished surface roughness can be improved by using the finer abrasives and, when using #3,000,000 (particle size of 5 nm), the excellent finished surface can be obtained on both the surface Si and the surface C, and any difference is not observed. It is to be noted that the processing efficiency is largely decreased when using such fine abrasives in the normal grinding because of clogging, but the excellent dressing acts even on superfine abrasives of #3,000,000 (particle size of 5 nm), which can thus constantly contribute to the processing.

As described above, the method and apparatus for cutting and grinding a single crystal SiC according to the present invention can efficiently cut out the ingot of the single crystal SiC in the tabular form, and its cut surface can be advantageously finished as flat as the mirror surface.

Incidentally, although the above has described the preferred embodiments according to the present invention, it will be understood that the true scope of the present invention can not be restricted to these embodiments. On the contrary, the scope of the invention includes improvements, modifications and equivalents included in the appended claims.

What is claimed is:

1. A method for cutting and grinding a single crystal SiC, wherein a metal bond grind stone is applied to a positive potential; an electrode opposed to said metal bond grind stone is applied to a negative potential; a conductive liquid is supplied between said metal bond grind stone and said electrode; an ingot of said single crystal SiC is cut by said metal bond grind stone while performing electrolytic dressing on the surface of said metal bond grind stone by applying a direct-current pulse voltage between said metal bond grind stone and said electrode; and the cut surface is then subjected to grinding by said metal bond grind stones wherein said metal bond grind stone consists of a flat plate portion which rotates around a shaft center and a tapered portion which is provided on the outside of said flat plate portion and formed so as to be gradually thinned toward the outer periphery thereof, thereby cutting said ingot of said single crystal SiC by said tapered portion and grinding the cut surface by said flat plate portion.

2. A method for cutting and grinding a single crystal SiC according to claim 1, wherein said metal bond grind stone consists of an iron cast based metal binding member and diamond abrasives having particle sizes different at said flat plate portion and said tapered portion.

3. A method for cutting and grinding a single crystal SiC comprising the steps of:

providing an apparatus for cutting and grinding a single crystal SiC, the apparatus comprising:

(a) a metal bond grind stone constituted by a flat plate portion which rotates around a shaft center and a tapered portion which is provided on the outside of the flat plate portion and formed so as to be gradually thinned toward an outer periphery thereof;

(b) an electrode opposed to the metal bond grind stone with a gap therebetween;

(c) voltage applying means for applying a direct-current pulse voltage between the metal bond grind stone that is capable of being applied to a positive potential and the electrode that is capable of being applied to a negative potential;

(d) conductive liquid supplying means for supplying a conductive liquid between the metal bond grind stone and the electrode; and (e) grind stone moving means for moving the metal bond grind stone in a direction orthogonal to the shaft center thereof, so that an ingot of a single crystal SiC is capable of being cut at the tapered portion of the metal bond grind stone to form a cut surface and the cut surface is capable of being subjected to grinding at the flat plate portion;

applying a positive potential to the metal bond grind stone;

applying a negative potential to the electrode;

supplying a conductive liquid between the metal grind stone and the electrode, wherein the conductive liquid is supplied by the conductive liquid supplying means;

cutting an ingot of single crystal SiC using the tapered portion of the metal bond grind stone so that a cut surface is formed on the ingot while performing electrolytic dressing on a surface of the metal bond grind stone by applying a direct-current pulse voltage between the metal bond grind stone and the electrode, wherein the voltage is applied by the voltage applying means; and subjecting the cut surface to grinding by the flat plate portion of the metal bond grind stone.

4. A method for cutting and grinding according to claim 3, wherein the flat plate portion comprises abrasive particles having particle diameters of 2 $\mu$m to 5 nm so that the cut surface of the ingot is ground by the abrasive particles of the flat plate portion.

5. A method for cutting and grinding according to claim 4, wherein the tapered portion comprises abrasive particles having particle sizes of #325 to #4000 so that the ingot is cut by the abrasive particles of the tapered portion.

6. An apparatus for cutting and grinding a single crystal SiC, comprising:

(a) a metal bond grind stone constituted by a flat plate portion which rotates around a shaft center and a tapered portion which is provided on the outside of the flat plate portion and formed so as to be gradually thinned toward an outer periphery thereof;

(b) an electrode opposed to the metal bond grind stone with a gap therebetween;

(c) voltage applying means for applying a direct-current pulse voltage between the metal bond grind stone that is applied to a positive potential and the electrode that is applied to a negative potential;

(d) conductive liquid supplying means for supplying a conductive liquid between the metal bond grind stone and the electrode; and (e) grind stone moving means for moving the metal bond grind stone in a direction orthogonal to the shaft center thereof, so that an ingot of a single crystal SiC is cut at the tapered portion of the metal bond grind stone to form a cut surface and the cut surface is subjected to grinding at the flat plate portion.

7. An apparatus for cutting and grinding according to claim 6, wherein the flat plate portion comprises abrasive particles having particle diameters of 2 $\mu$m to 5 nm.

8. An apparatus for cutting and grinding according to claim 7, wherein the tapered portion comprises abrasive particles having particle sizes of #325 to #4000.

* * * * *